US007051998B2

(12) United States Patent
Sleiman

(10) Patent No.: US 7,051,998 B2
(45) Date of Patent: May 30, 2006

(54) LEVERAGE HAMMER

(76) Inventor: Tony Sleiman, 589 Banwell Road, Windsor, Ontario (CA) N8P 1J8

( * ) Notice: Subject to any disclaimer, the term of this patent is extended or adjusted under 35 U.S.C. 154(b) by 32 days.

(21) Appl. No.: 10/843,831

(22) Filed: May 12, 2004

(65) Prior Publication Data

US 2005/0017225 A1 Jan. 27, 2005

Related U.S. Application Data

(60) Provisional application No. 60/470,141, filed on May 13, 2003.

(51) Int. Cl.
*B25C 11/00* (2006.01)

(52) U.S. Cl. ..... 254/26 E

(58) Field of Classification Search ..... 254/26 E, 254/26 R, 27

See application file for complete search history.

(56) References Cited

U.S. PATENT DOCUMENTS 540,967 A 6/1895 Eveleth
856,097 A 6/1907 Palmer
2,589,046 A 3/1952 Brown et al.
2,589,047 A 3/1952 Brown et al.
2,741,456 A * 4/1956 Williams ..... 254/26 E
4,998,996 A 3/1991 Belanger
5,441,236 A 8/1995 Kiernan

OTHER PUBLICATIONS

European International Search Report for EP 04 25 6756, Apr. 4, 2005, 9 pages.

* cited by examiner

*Primary Examiner*—Robert C. Watson
(74) *Attorney, Agent, or Firm*—Warn, Hoffmann, Miller & LaLone, P.C.

(57) ABSTRACT

A selectively operable extendable fulcrum device is described. The device includes a casing with a slot to selectively guide and lock a selectively telescoping rod into place when extended. A ridge on the inside of the casing provides a resting place for a compression spring. The compression spring is operable to selectively retract the telescoping rod back into its retracted position and keeps the telescoping rod and fulcrum head assembly securely in place when retracted. The fulcrum head provides added leverage needed to pull out nails from materials when it is retracted as well as providing added leverage for longer nails when the fulcrum head is extended. The casing and the associated components of the device can be press fit into any conventional hammer head member.

32 Claims, 3 Drawing Sheets

LEVERAGE HAMMER

CROSS-REFERENCE TO RELATED APPLICATION

This application claims the benefit of U.S. Provisional Patent Application Ser. No. 60/470,141, filed May 13, 2003, the entire specification of which is expressly incorporated herein by reference.

FIELD OF THE INVENTION

The present invention relates generally to fulcrum devices, and more particularly to a selectively operable extendable fulcrum device that can be at least partially disposed within the head of a hammer and is operable to extend out from the head of the hammer to provide added leverage needed to, among other things, pull nails out from material without the need for another object to be placed under the head of the hammer to provide the requisite amount of leverage.

BACKROUND OF THE INVENTION

Referring to FIG. 1, there is shown a claw hammer 10, in accordance with the prior art. The claw hammer 10 includes a handle member 12 and a head member 14. The head member 14 further includes a face portion 16, a throat portion 18, a neck portion 20, a cheek portion 22, an eye portion 24, and a claw portion 26.

When a claw hammer is used to pull out nails, it is generally considered to be a first class lever. The fulcrum, which is the curved portion of the head of the claw hammer, helps to provide the requisite leverage needed to pull out the nail (i.e., the load) by manipulating the handle of the hammer (i.e., the effort). As the nail is pulled out far enough to cause the face portion of the head of the hammer to contact the work piece, the leverage that was provided by the curve on the head of the hammer is essentially lost. The needed effort to further remove the nail thus becomes greater as the fulcrum moves away from the load In order to regain that leverage. Accordingly, it is generally necessary for the user to place an object (e.g., a block) below the hammer head in order to raise it and move the fulcrum back to its original location, i.e., as close to the load, as possible. Thus, when a claw hammer is used, for example, to remove a nail, especially a long nail, from a piece of material, e.g., such as wood, it is often necessary for the user to place an object below the head of the hammer to help remove the nail, i.e., to provide the requisite amount of leverage.

Sometimes, a type of claw hammer is used to tear material apart. This hammer is generally referred to as a rip hammer. A rip hammer is suitable for tearing things apart because it has a flatter head and therefore permits the claws to dig deep into material to pry them apart. Because the head of the rip hammer is relatively flat, it typically lacks the fulcrum capability that is needed to pull out nails, and, as a result, the rip hammer generally performs poorly when attempting to pull out nails.

Accordingly, there exists a need for a new and improved fulcrum device, and method for using the same, to provide the requisite amount of leverage to any type of hammer so as to permit the easy removal of objects from various materials.

SUMMARY OF THE INVENTION

A new and improved fulcrum device is provided, in accordance with the general teachings of the present invention.

More specifically, the present invention is primarily directed to a selectively operable extendable fulcrum device that can be inserted into any type of hammer head (e.g., claw, rip, and the like) so as to provide additional leverage for, among other things, pulling out nails without resort to the use of another object placed under the head of the hammer.

The extendable fulcrum device preferably includes a substantially cylindrical hollow metallic casing member with a substantially L-shaped slot formed therein. On an internal surface of the casing member, there is preferably provided a ridge surface at one end thereof that permits a metallic compression spring to rest against it. Preferably, a cylindrical metallic rod is provided, with a cam or lobe shaped head at one end thereof and threaded portion at the other end, that preferably moves, through the compression spring, in and out of the casing member while the cam head moves through an axial portion of the slot.

A substantially rounded and threaded fulcrum head preferably screws onto the threaded portion of the rod. The compression spring preferably keeps the rod retracted inside the casing member. When the fulcrum head is pulled outwardly from the casing member, the spring preferably compresses, wherein rotating the rod preferably allows the cam head to lock into a perpendicular portion of the slot of the casing member. To retract the fulcrum assembly, the fulcrum head is preferably twisted in the opposite direction so as to allow the cam member to disengage from the perpendicular portion of the slot and slide down along the axial portion of the slot towards the bottom of the casing member.

In accordance with a first embodiment of the present invention, a fulcrum device is provided, comprising: (1) a fulcrum member having a convex first major face and an opposed second major face; (2) a stem member extending from the second major face; (3) substantially hollow casing member; and (4) a spring member disposed within the casing member; wherein the stem member is slidably received within the spring member, wherein the stem member is selectively operable for axial movement within the casing member.

In accordance with a second embodiment of the present invention, a fulcrum device is provided, comprising: (1) a fulcrum member having a convex first major face and an opposed second major face; (2) a stem member extending from the second major face, the stem member having a protuberance formed at a terminal portion thereof; (3) a substantially hollow casing member having a slot formed in a surface thereof; and (4) a spring member disposed within the casing member; wherein the stem member is slidably received within the spring member, wherein the stem member is selectively operable for axial movement within the casing member, wherein the protuberance is selectively operable to engage a surface of the slot so as to substantially prevent axial movement of the stem member.

In accordance with a third embodiment of the present invention, a fulcrum device is provided, comprising: (1) a fulcrum member having a convex first major face and an opposed second major face; (2) a stem member extending from the second flat major face, the stem member having a protuberance formed at a terminal portion thereof; (3) a substantially hollow casing member having a substantially L-shaped slot formed in a surface thereof; and (4) a spring member disposed within the casing member; wherein the stem member is slidably received within the spring member, wherein the stem member is selectively operable for axial movement within the casing member, wherein the protuberance is selectively operable to engage a surface of the L-shaped slot when the protuberance is rotated approximately 90 degrees so as to substantially prevent axial movement of the stem member.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is no way intended to limit the invention, its application, or uses.

Figure 1:
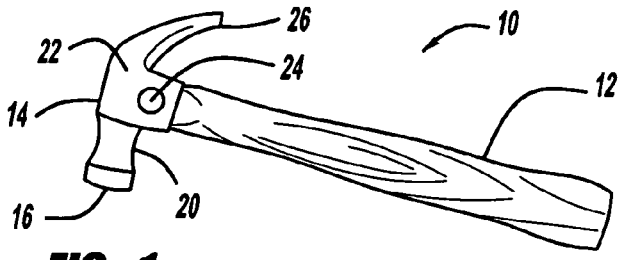
FIG - 1 Prior Art
FIG. 1 depicts a side view of a claw hammer, in accordance with the prior art.
Figure 2:
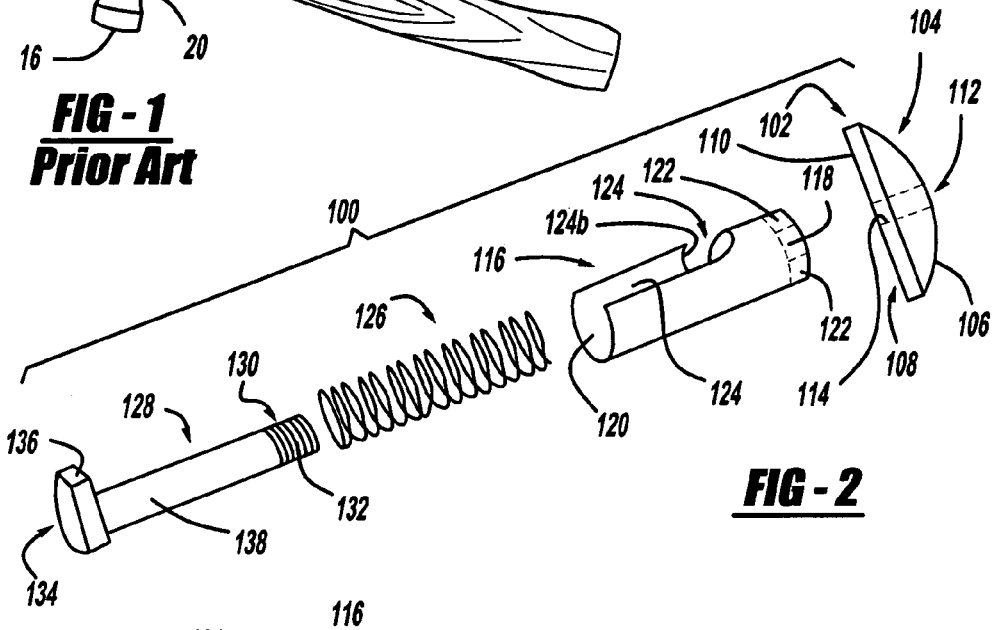
FIG. 2 depicts an exploded view of a fulcrum device, in accordance with the general teachings of the present invention.

Referring to FIG. 2, there is shown a fulcrum device 100, in accordance with the general teachings of the present invention. The fulcrum device 100 preferably includes a fulcrum head 102 that preferably includes a first major face 104 that preferably has a substantially convex or rounded surface 106 formed thereon and an opposed second major face 108 that has a substantially flat surface 110 formed thereon. Along a central axis of the fulcrum head 102, an engagement surface 112, for example, a threaded surface 114, is preferably provided. The fulcrum head 102 may be comprised of any number of materials, but is preferably comprised of metallic materials.

A casing member 116 is preferably provided, wherein the casing member 116 is preferably comprised of a substantially hollow member. In accordance with a preferred embodiment of the present invention, the casing member 116 is preferably substantially cylindrical. The casing member 116 preferably includes two ends 118, 120, respectively, that are preferably open. At one end of the casing member 116, a ridge or shoulder member 122, is preferably provided on an inner surface thereof. A slot 124 is preferably formed in a surface of the casing member 116. In accordance with a preferred embodiment of the present invention, the slot 124 is preferably substantially L-shaped, i.e., it includes an axial portion 124*a* and a perpendicular portion 124*b*. The casing member 116 may be comprised of any number of materials, but is preferably comprised of metallic materials.

A spring member 126 is preferably provided. In accordance with a preferred embodiment of the present invention, the spring member 116 is preferably substantially cylindrical. The spring member 126 is preferably substantially compressible in response to a compressive forced applied thereto. The spring member 126 may be configured in any number of configurations, but is preferably helically shaped. The spring member 126 is preferably operable to be slidably received within the cavity of the casing member 116. In accordance with a preferred embodiment of the present invention, the spring member 126 is preferably operable to rest against the ridge member 122 of the casing member 116. The spring member 126 may be comprised of any number of materials, but is preferably comprised of metallic materials.

A rod or stem member 128 is preferably provided. The rod member 128 may be comprised of any number of materials, but is preferably comprised of metallic materials. At one end of the rod member 128, an engagement member 130, such as a threaded surface 132 is preferably provided. At the other end of the rod member 128, a protuberance 134, such as a cam or lobe shaped member 136 is preferably provided. In accordance with a preferred embodiment of the present invention, at least a portion 138 of the rod member 128 is preferably substantially cylindrical. The rod member 128 is preferably operable to be slidably received within the spring member 126. In accordance with a preferred embodiment of the present invention, the threaded surface 132 of the rod member 128 is intended to engage the threaded surface 114 of the fulcrum head 102 so as to secure the rod member 128 to the fulcrum head 102.

Figure 3:
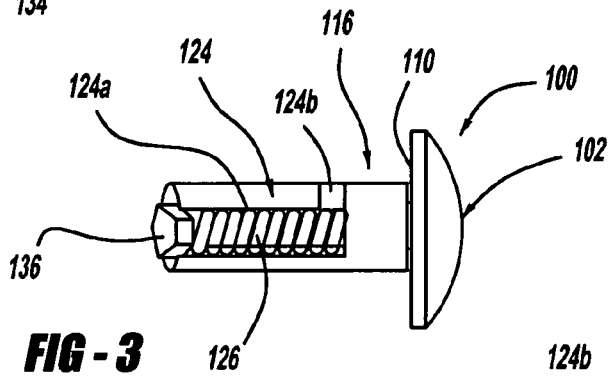
FIG. 3 depicts a side view of the fulcrum device in the retracted position, in accordance with one embodiment of the present invention.

Referring to FIG. 3, the fulcrum device 100 is shown in its retracted position. The tension force of the spring member 126 keeps the rod member 128 in the retracted position until a stronger compressive force is applied to the spring sufficient to overcome its tension force. If that occurs, the rod member 128 is operable to travel along the axial length of the casing member 116. Additionally, the cam member 136 is preferably configured so as to be operable to slide within the axial portion 124*a* of the slot 124, when the cam member 136 is parallel to the axial portion 124*a*.

Figure 4:
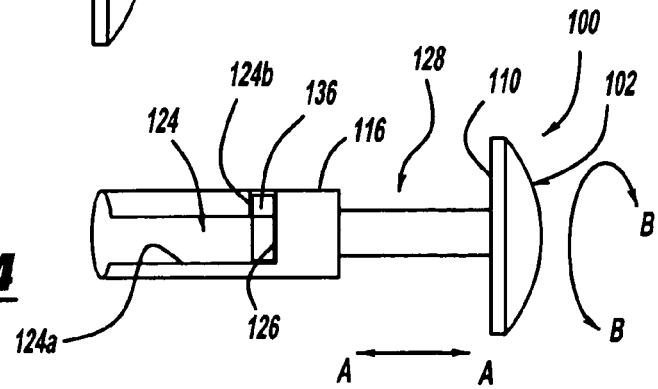
FIG. 4 depicts a side view of the fulcrum device in the extended position, in accordance with a first alternative embodiment of the present invention.

Referring to FIG. 4, the fulcrum device 100 is shown in its extended position. As the cam member 136 moves upwardly in the slot 124 in the direction of arrow A, the spring member 126 is compressed against the ridge member 122 of the casing member 116. This preferably permits axial movement of the rod member 128 relative to the casing member 116. When the cam member 136 is in proximity to the perpendicular portion 124*b* of the slot 124, the cam member 136 is preferably operable to be rotated, in the direction of arrow B, a sufficient amount so as to engage the perpendicular portion 124*b* and prevent axial movement of the rod member 128 relative to the casing member 116. The direction of, or exact amount of, rotation is not thought to be critical to the success of the present invention, provided that the cam member 136 is able to engage the perpendicular portion 124*b* of the slot 124, or in the alternative, able to prevent axial movement of the rod member 128 relative to the casing member 116. In accordance with a preferred embodiment of the present invention, the amount of rotation is preferably about 90 degrees. Once it is preferred to return the rod member 128 to its retracted position, the cam member 136 is rotated in the opposite direction so as to disengage from the perpendicular portion 124*b* of the slot 124 and align with the axial portion 124*a* of the slot 124, whereupon the rod member 128 will automatically snap back to its retracted position by the action of the spring member 126.

Figure 5:
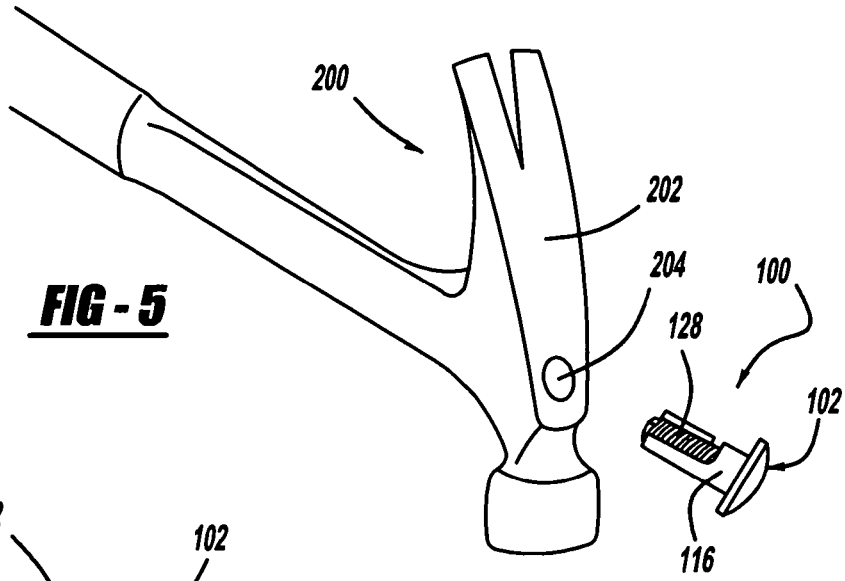
FIG. 5 depicts a partial exploded view of an intended placement of the fulcrum device in the head of a hammer, in accordance with a second alternative embodiment of the present invention.
Figure 6:
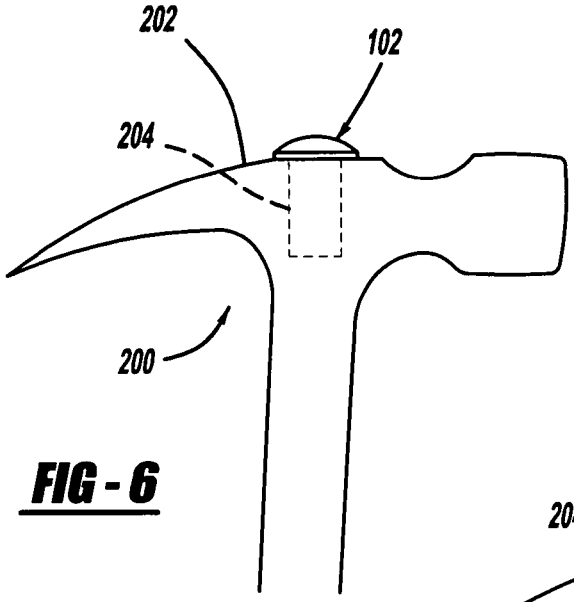
FIG. 6 depicts a partial side view of the fulcrum device in the head of a hammer, wherein the fulcrum device is shown in its retracted position, in accordance with a third alternative embodiment of the present invention.
Figure 7:
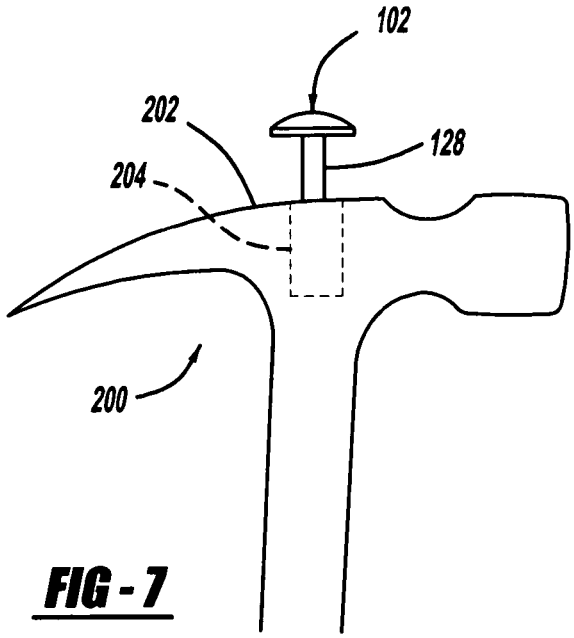
FIG. 7 depicts a partial side view of the fulcrum device in the head of a hammer, wherein the fulcrum device is shown in its extended position, in accordance with a fourth alternative embodiment of the present invention.

Referring to FIGS. 5–7, there is shown an intended placement of the fulcrum device 100 in a hammer 200, and more specifically, the head portion 202 of the hammer 200. In accordance with a preferred embodiment of the present invention, an area defining a bore 204 is provided in the head portion 202. Preferably, the bore 204 is configured so as to provide a relatively tight press fit with the fulcrum device 100. Optionally, an adhesive material may be employed to secure a portion of the casing member 116 to a surface of the bore 204, provided that the adhesive material does not interfere with the relatively free movement of the fulcrum member 102 and/or rod member 128. Once the fulcrum device 100 is fully recessed into the bore 204 in the retracted position (see FIG. 6), only the fulcrum member 102 is plainly visible. In the extended position (see FIG. 7), the fulcrum member 102 and rod member 128 are plainly visible.

Figure 8:
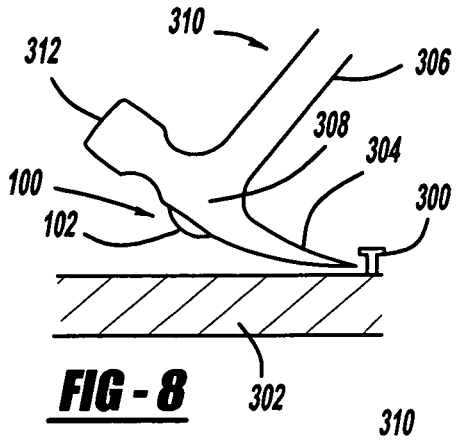
FIGS. 8–10 depict the major steps of using the fulcrum device in its retracted position to remove an object from a piece of material, in accordance with a fifth alternative embodiment of the present invention.
Figure 9:
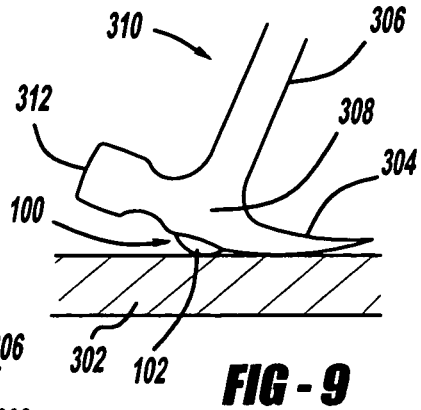
Figure 10:
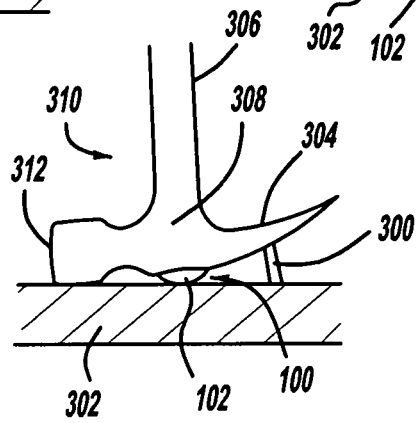

Referring to FIGS. 8–10, there is depicted the major illustrative steps of using the fulcrum device 100 in its retracted position to aid in the removal of an object, in this case a nail 300 from a piece of material, in this case a piece of wood 302. In FIG. 8, the claw portion 304 of a hammer 306 first engages the nail 300. In FIG. 9, the fulcrum member 102 makes contact with the surface of the wood 302 as the claw portion 304 makes further contact with the nail 300. In FIG. 10, the fulcrum member 102 allows the head portion 308 of the hammer 306 to exert greater leverage to the hammer 306 as the handle 310 is pulled in the direction away from the nail 300 and the face portion 312 makes contact with the surface of the wood 302. At this point, the nail 300, because of its long length, is still embedded in the piece of wood 302; however, if the nail 300 were not very long, it would have most probably been extracted from the piece of wood 302.

Figure 11:
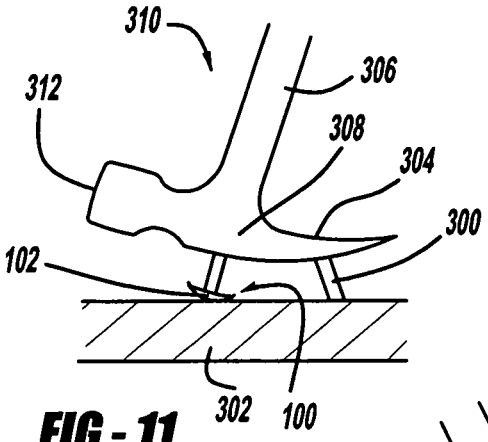
FIGS. 11–13 depict the major steps of using the fulcrum device in its extended position to remove an object from a piece of material, in accordance with a fifth alternative embodiment of the present invention.
Figure 12:
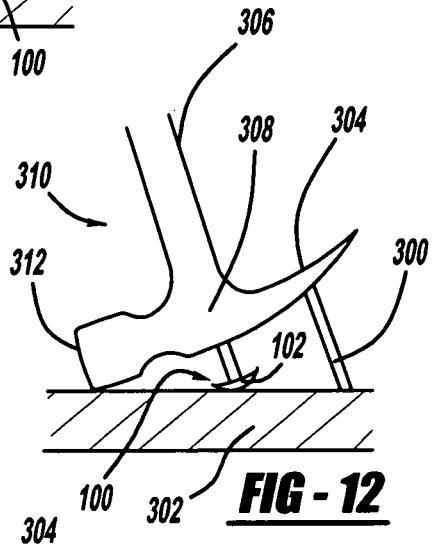
Figure 13:
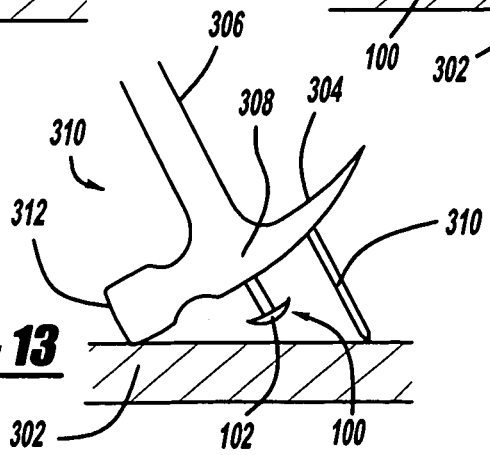

In order to extract the nail 300, it is necessary to extend the fulcrum device 100 from the head portion 308. FIGS. 11–13 depict the major illustrative steps of using the fulcrum device 100 in its extended position to remove an object from a piece of material. In FIG. 11, the fulcrum member 102 has been extended, via the rod member 128, and the claw portion 304 of the hammer 306 has reengaged the partially extracted nail 300. In FIG. 12, the fulcrum member 102 permits the application of a relatively great amount of leverage to the hammer 306, as the handle is pulled in the direction away from the nail 300. In FIG. 13, the nail 300 is finally completely extracted from the piece of wood 302, as the face portion 312 again makes contact with the surface of the wood 302.

The description of the invention is merely exemplary in nature and, thus, variations that do not depart from the gist of the invention are intended to be within the scope of the invention. Such variations are not to be regarded as a departure from the spirit and the scope of the invention.

What is claimed is:

1. A fulcrum device, comprising:

a fulcrum member having a convex first major face and an opposed second major face;

a stem member extending from the second major face, said stem member including a protuberance formed at a terminal portion thereof;

a substantially hollow casing member; and a spring member disposed within the casing member; wherein the stem member is slidably received within the spring member, wherein the stem member is selectively operable for axial movement within the casing member; and said protuberance is selectively operable to compress the spring member against an internal surface of the casing member.

2. The invention according to claim 1, wherein the fulcrum member includes an engagement surface for receiving at least a portion of the stem member.

3. The invention according to claim 1, wherein the casing member is substantially cylindrical.

4. The invention according to claim 1, wherein the casing member has a slot formed in a surface thereof.

5. The invention according to claim 4, wherein the protuberance is selectively operable to engage a surface of the slot so as to substantially prevent axial movement of the stem member.

6. The invention according to claim 4, wherein the protuberance is selectively operable to move axially along a surface of the slot so as to allow axial movement of the stem member.

7. The invention according to claim 1, wherein the casing member has a substantially L-shaped slot formed in a surface thereof.

8. The invention according to claim 7, wherein the protuberance is selectively operable to engage a surface of the L-shaped slot when the protuberance is rotated approximately 90 degrees so as to substantially prevent axial movement of the stem member.

9. The invention according to claim 1, wherein at least a portion of the casing member is operable to be received in an area defining an aperture formed in a head portion of a hammer.

10. The invention according to claim 9, wherein the stem member is selectively operable to extend away from the surface of the hammer head.

11. The invention according to claim 10, wherein the stem member is selectively operable to remain in a fixed position when extended away from the surface of the hammer head.

12. The invention according to claim 1, wherein the fulcrum member is selectively operable to provide an amount of leverage to a head portion of a hammer.

13. A fulcrum device, comprising:

a fulcrum member having a convex first major face and an opposed second major face;

a stem member extending from the second major face, the stem member having a protuberance formed at a terminal portion thereof;

a substantially hollow casing member having a slot formed in a surface thereof; and a spring member disposed within the casing member; wherein the stem member is slidably received within the spring member, wherein the stem member is selectively operable for axial movement within the casing member, wherein the protuberance is selectively operable to engage a surface of the slot so as to substantially prevent axial movement of the stem member.

14. The invention according to claim 13, wherein the fulcrum member includes an engagement surface for receiving at least a portion of the stem member.

15. The invention according to claim 13, wherein the protuberance is selectively operable to compress the spring member against an internal surface of the casing member.

16. The invention according to claim 13, wherein the casing member is substantially cylindrical.

17. The invention according to claim 13, wherein the casing member has a substantially L-shaped slot formed in a surface thereof.

18. The invention according to claim 17, wherein the protuberance is selectively operable to engage a surface of the L-shaped slot when the protuberance is rotated approximately 90 degrees so as to substantially prevent axial movement of the stem member.

19. The invention according to claim 18, wherein the protuberance is selectively operable to move axially along a surface of the L-shaped slot so as to allow axial movement of the stem member.

20. The invention according to claim 13, wherein at least a portion of the casing member is operable to be received in an area defining an aperture formed in a head portion of a hammer.

21. The invention according to claim 20, wherein the stem member is selectively operable to extend away from the surface of the hammer head.

22. The invention according to claim 21, wherein the stem member is selectively operable to remain in a fixed position when extended away from the surface of the hammer head.

23. The invention according to claim 13, wherein the fulcrum member is selectively operable to provide an amount of leverage to a head portion of a hammer.

24. A fulcrum device, comprising:

a fulcrum member having a convex first major face and an opposed second major face;

a stem member extending from the second flat major face, the stem member having a protuberance formed at a terminal portion thereof;

a substantially hollow casing member having a substantially L-shaped slot formed in a surface thereof; and a spring member disposed within the casing member; wherein the stem member is slidably received within the spring member, wherein the stem member is selectively operable for axial movement within the casing member, wherein the protuberance is selectively operable to engage a surface of the L-shaped slot when the protuberance is rotated approximately 90 degrees so as to substantially prevent axial movement of the stem member.

25. The invention according to claim 24, wherein the fulcrum member includes an engagement surface for receiving at least a portion of the stem member.

26. The invention according to claim 24, wherein the protuberance is selectively operable to compress the spring member against an internal surface of the casing member.

27. The invention according to claim 24, wherein the casing member is substantially cylindrical.

28. The invention according to claim 24, wherein the protuberance is selectively operable to move axially along a surface of the L-shaped slot so as to allow axial movement of the stem member.

29. The invention according to claim 24, wherein at least a portion of the casing member is operable to be received in an area defining an aperture formed in a head portion of a hammer.

30. The invention according to claim 29, wherein the stem member is selectively operable to extend away from the surface of the hammer head.

31. The invention according to claim 30, wherein the stem member is selectively operable to remain in a fixed position when extended away from the surface of the hammer head.

32. The invention according to claim 24, wherein the fulcrum member is selectively operable to provide an amount of leverage to a head portion of a hammer.

* * * * *